US005884251A

United States Patent [19]

Kim et al.

[11] Patent Number: 5,884,251

[45] Date of Patent: Mar. 16, 1999

[54] VOICE CODING AND DECODING METHOD AND DEVICE THEREFOR

[75] Inventors: Hong-kook Kim; Yong-duk Cho, both of Suwon; Moo-young Kim, Sungnam; Sang-ryong Kim, Yongin, all of Rep. of Korea

[73] Assignee: Samsung Electronics Co., Ltd., Sumon, Rep. of Korea

[21] Appl. No.: 863,956

[22] Filed: May 27, 1997

[30] Foreign Application Priority Data

May 25, 1996 [KR] Rep. of Korea ..... 1996 17932

[51] Int. Cl.[6] ..... G10L 3/02; G10L 9/00

[52] U.S. Cl. ..... 704/219; 704/220

[58] Field of Search ..... 704/262, 219, 704/220

[56] References Cited

U.S. PATENT DOCUMENTS 5,265,167 11/1993 Akamine ..... 704/219

OTHER PUBLICATIONS

Parsons, T.W. et al., Voice and Speech Processing, McGraw Hill series in elec. eng., p. 264, Dec. 30, 1987.

Telecommunication Standardization Sector, Study Group, Geneva, May 27–Jun. 7, 1996, NEC Corp. High Level Description of Proposed NEC 4 kbps Speech Codec Candidate, M. Serizawa.

U.S. Dept. of Defense, The DOD 4.8 KBPS Standard (Proposed Federal Standard 1016), Campbell, et al. pp. 121–133.

*Primary Examiner*—David R. Hudspeth
*Assistant Examiner*—Robert Louis Sax
*Attorney, Agent, or Firm*—Foley & Lardner

[57] ABSTRACT

In a voice coding and decoding method and apparatus using an RCELP technique, a CELP-series decoder can be obtained at a low transmission rate. A voice spectrum is extracted by performing a short-term linear prediction on voice signal. An error range in a formant region is widened during adaptive and renewal codebook search by passing said preprocessed voice through a formant weighting filter and widening an error range in a pitch on-set region by passing the same through a voice synthesis filter and a harmonic noise shaping filter. An adaptive codebook is searched using an open-loop pitch extracted on the basis of the residual minus of a speech. A renewal excited codebook produced from an adaptive codebook excited signal is searched. Finally, a predetermined bit is allocated to various parameters to form a bit stream.

10 Claims, 11 Drawing Sheets

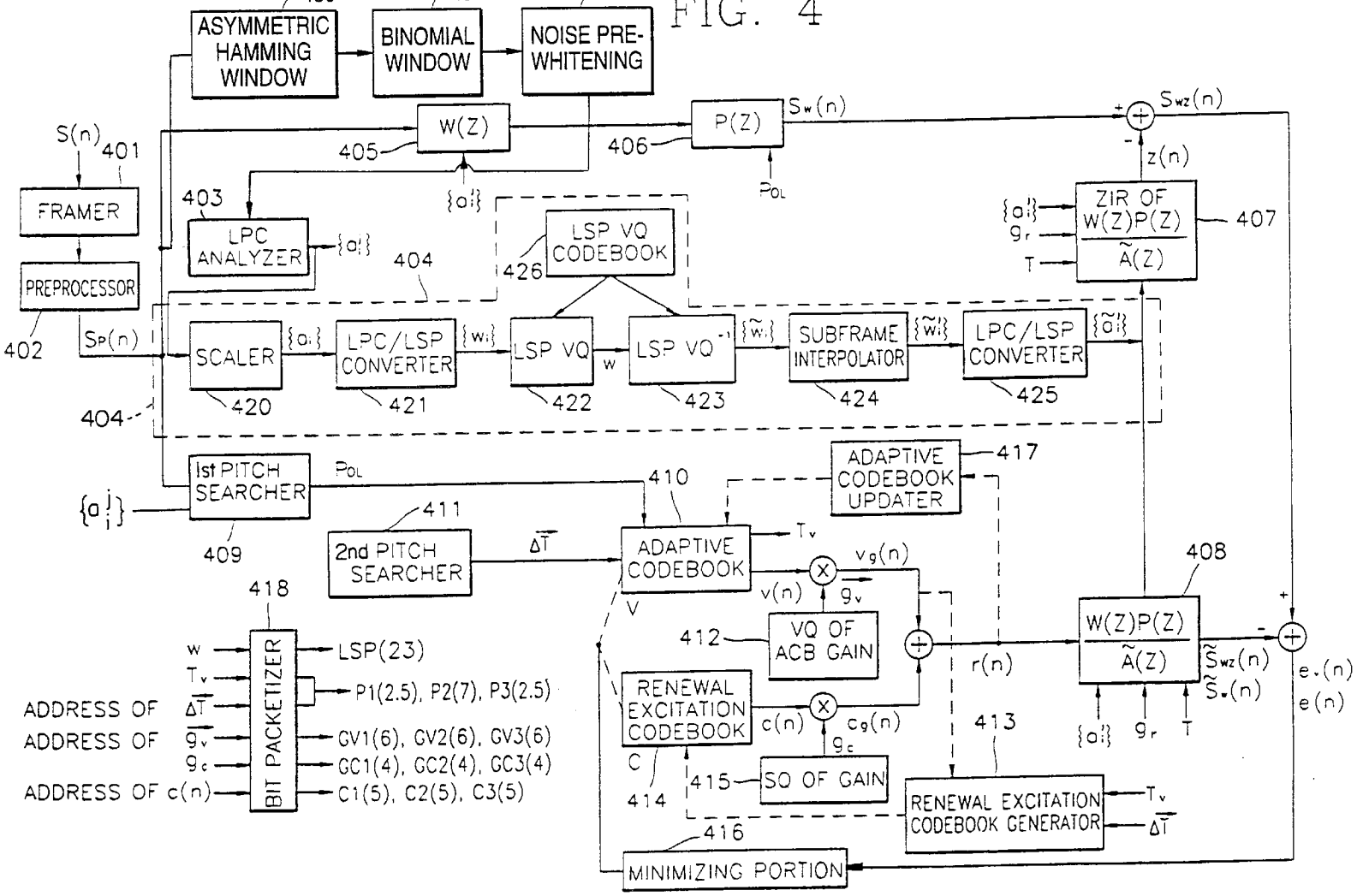
FIG. 4
ASYMMETRIC HAMMING WINDOW
BINOMIAL WINDOW
NOISE PRE-WHITENING
FRAMER
PREPROCESSOR
LPC ANALYZER
W(Z)
P(Z)
ZIR OF W(Z)P(Z)/Ã(Z)
LPC/LSP CONVERTER
SCALER
LSP VQ
LSP VQ CODEBOOK
LSP VQ⁻¹
SUBFRAME INTERPOLATOR
1st PITCH SEARCHER
2nd PITCH SEARCHER
ADAPTIVE CODEBOOK UPDATER
ADAPTIVE CODEBOOK
VQ OF ACB GAIN
RENEWAL EXCITATION CODEBOOK
SQ OF GAIN
RENEWAL EXCITATION CODEBOOK GENERATOR
MINIMIZING PORTION
BIT PACKETIZER
LSP(23)
P1(2.5), P2(7), P3(2.5)
GV1(6), GV2(6), GV3(6)
GC1(4), GC2(4), GC3(4)
C1(5), C2(5), C3(5)
ADDRESS OF w
ADDRESS OF Tv, ΔT
ADDRESS OF gv, gc
ADDRESS OF c(n)

FIG. 8

| Condition | Codec | Bit error rate | No. Async. tandemmings | Input level, dB rel. digital overloaded |
|---|---|---|---|---|
| C1 | MNRU, Q=5dB | | - | -26 |
| C2 | MNRU, Q=15dB | | - | -26 |
| C3 | MNRU, Q=25dB | | - | -26 |
| C4 | MNRU, Q=50dB | | - | -26 |
| C5 | 4kbit/s codec | 3% missing random erasured frames | 1 | -26 |
| C6 | 32 kbit/s ADPCM | | 1 | -16dB |
| C7 | 32 kbit/s ADPCM | | 1 | -26dB |
| C8 | 32 kbit/s ADPCM | | 1 | -36dB |
| C9 | 32 kbit/s ADPCM | | 4 | -26dB |
| C10 | 32 kbit/s ADPCM | 0.02% random | 1 | -26dB |
| C11 | 4kbit/s codec | | 1 | -16dB |
| C12 | 4kbit/s codec | | 1 | -26dB |
| C13 | 4kbit/s codec | | 1 | -36dB |
| C14 | 4kbit/s codec | | 2 | -26dB |
| C15 | 4kbit/s codec | 0.1% random | 1 | -26dB |

FIG. 9

| Condition | Noise | SNR (dB) | Transcoding | Ref (dB) | Input Char | Quality Ref | Codec |
|---|---|---|---|---|---|---|---|
| C1 | None | - | 1 | - | A/m-law, mod-IRS | DIRECT | a |
| C2 | Babble | 30 | 1 | - | A/m-law, mod-IRS | DIRECT | a |
| C3 | Vehicle | 20 | 1 | - | A/m-law, mod-IRS | DIRECT | a |
| C4 | Interf-Tk | 20 | 1 | - | A/m-law, mod-IRS | DIRECT | a |
| C5 | Interf-Tk | 20 | 2 | - | A/m-law, mod-IRS | DIRECT | a |
| C6 | None | - | 1 | - | A/m-law, mod-IRS | DIRECT | G726 |
| C7 | Babble | 30 | 1 | - | A/m-law, mod-IRS | DIRECT | G726 |
| C8 | Vehicle | 20 | 1 | - | A/m-law, mod-IRS | DIRECT | G726 |
| C9 | Interf-Tk | 20 | 1 | - | A/m-law, mod-IRS | DIRECT | G726 |
| C10 | Interf-Tk | 20 | 2 | - | A/m-law, mod-IRS | DIRECT | G726 |
| C11 | None | - | | 6dB | UPCM, mod-IRS | DIRECT | MNRU |
| C12 | None | - | | 12dB | UPCM, mod-IRS | DIRECT | MNRU |
| C13 | None | - | | 18dB | UPCM, mod-IRS | DIRECT | MNRU |
| C14 | None | - | | 24dB | UPCM, mod-IRS | DIRECT | MNRU |
| C15 | None | - | | 30dB | UPCM, mod-IRS | DIRECT | MNRU |
| C16 | None | - | | - | UPCM, mod-IRS | DIRECT | DIRECT |
| C17 | Babble | 30 | | - | UPCM, mod-IRS | DIRECT | DIRECT |
| C18 | Vehicle | 20 | | - | UPCM, mod-IRS | DIRECT | DIRECT |
| C19 | Interf-Tk | 20 | | - | UPCM, mod-IRS | DIRECT | DIRECT |
| C20 | Interf-Tk | 20 | | - | UPCM, mod-IRS | DIRECT | DIRECT |

FIG. 10

| Condition | | $MOS_c$, male talkers | | $MOS_c$, female talkers | | $\overline{MOS_C}$ | $S_c$ |
|---|---|---|---|---|---|---|---|
| | | M1 | M2 | F1 | F2 | All talkers | All talkers |
| C1 | MNRU 5dB | 2.271 | 2.354 | 2.104 | 2.125 | 2.214 | 0.753 |
| C2 | MNRU 15dB | 3.938 | 3.833 | 3.188 | 3.250 | 3.552 | 0.620 |
| C3 | MNRU 25dB | 4.000 | 3.958 | 4.000 | 3.958 | 3.979 | 0.204 |
| C4 | MNRU 50dB | 3.938 | 3.958 | 3.938 | 3.958 | 3.948 | 0.285 |
| C5 | 4kbps Fr. Er. | 2.021 | 1.708 | 1.563 | 1.521 | 1.703 | 0.738 |
| C6 | G.726-16dB | 3.958 | 3.938 | 3.854 | 3.917 | 3.917 | 0.344 |
| C7 | G.726-26dB | 3.750 | 3.688 | 3.688 | 3.854 | 3.745 | 0.460 |
| C8 | G.726-36dB | 3.104 | 2.979 | 3.000 | 3.125 | 3.052 | 0.603 |
| C9 | G.726 4T | 3.000 | 2.938 | 2.917 | 3.063 | 2.979 | 0.686 |
| C10 | G.726 Rand | 3.396 | 3.313 | 3.208 | 3.333 | 3.313 | 0.676 |
| C11 | 4kbps-16dB | 3.854 | 3.563 | 3.521 | 3.708 | 3.661 | 0.574 |
| C12 | 4kbps-26dB | 3.771 | 3.667 | 3.545 | 3.667 | 3.661 | 0.574 |
| C13 | 4kbps-36dB | 2.896 | 3.229 | 3.083 | 3.167 | 3.094 | 0.695 |
| C14 | 4kbps 2T | 2.750 | 2.656 | 2.604 | 2.354 | 2.589 | 0.764 |
| C15 | 4kbps Rand | 1.521 | 1.833 | 1.396 | 1.458 | 1.552 | 0.620 |

FIG. 11

| 条件 | | Average | | Standard deviation | | Hypothesis test |
|---|---|---|---|---|---|---|
| | | Reference | Candidate | Reference | Candidate | |
| Error Free | | 3.745 | 3.661 | 0.460 | 0.574 | 0.083≤0.104 |
| Random Bit Error | | 3.313 | 1.552 | 0.676 | 0.620 | 1.760>0.130 |
| Tandem | | 2.979 | 2.589 | 0.686 | 0.767 | 0.391>0.146 |
| Input Level | +10dB | 3.917 | 3.661 | 0.344 | 0.574 | 0.255>0.095 |
| | -10dB | 3.052 | 3.094 | 0.603 | 0.695 | -0.042≤0.130 |

FIG. 12

| | Observed frequency | | Hypothesis Test |
|---|---|---|---|
| | Reference | Candidate | |
| PoW | 21.2 | 170.0 | 230.6 > 2.706 |
| FoW | 170.8 | 22.0 | |
| Total | 192.0 | 192.0 | |

FIG. 13

| condition | | | $MOS_C$ (male talkers) | | | | $MOS_C$ (female talkers) | | | | $\overline{MOS_C}$ | $S_C$ |
|---|---|---|---|---|---|---|---|---|---|---|---|---|
| | | | M1 | M2 | M3 | M4 | F1 | F2 | F3 | F4 | All talkers | All talkers |
| C1 | Clean | 4 kbps | -0.167 | -0.125 | -0.146 | -0.271 | -0.750 | -0.667 | -0.750 | -0.938 | -0.477 | 0.470 |
| C2 | Babble | 4 kbps | -0.542 | -0.167 | | | -0.604 | -0.708 | | | -0.505 | 0.564 |
| C3 | Vehicle | 4 kbps | -0.667 | -0.438 | | | -0.521 | -0.875 | | | -0.625 | 0.646 |
| C4 | Int-Tk 1T | 4 kbps | -0.229 | -0.208 | | | -0.833 | -0.542 | | | -0.453 | 0.579 |
| C5 | Int-Tk 2T | 4 kbps | -0.146 | -0.250 | | | -0.729 | -0.708 | | | -0.458 | 0.574 |
| C6 | Clean | G.726 | -0.042 | -0.021 | 0.000 | -0.188 | 0.021 | -0.042 | -0.042 | 0.000 | -0.029 | 0.229 |
| C7 | Babble | G.726 | -0.042 | -0.042 | | | -0.083 | -0.062 | | | -0.057 | 0.149 |
| C8 | Vehicle | G.726 | -0.042 | -0.021 | | | 0.000 | 0.000 | | | -0.016 | 0.146 |
| C9 | Int-Tk 2T | G.726 | -0.042 | -0.062 | | | -0.062 | -0.125 | | | -0.073 | 0.218 |
| C10 | Int-Tk 2T | G.726 | -0.042 | -0.042 | | | -0.021 | -0.083 | | | -0.047 | 0.153 |
| C11 | 6dB | MNRU | -1.396 | | | | -1.792 | | | | -1.594 | 1.241 |
| C12 | 12dB | MNRU | -0.708 | | | | -1.312 | | | | -1.010 | 0.894 |
| C13 | 18dB | MNRU | -0.062 | | | | -0.500 | | | | -0.219 | 0.407 |
| C14 | 24dB | MNRU | 0.000 | | | | -0.042 | | | | -0.021 | 0.067 |
| C15 | 30dB | MNRU | -0.021 | | | | 0.062 | | | | 0.042 | 0.111 |
| C16 | Clean | Direct | -0.042 | | | | 0.021 | | | | 0.031 | 0.112 |
| C17 | Babble | Direct | 0.000 | | | | 0.000 | | | | 0.000 | 0.146 |
| C18 | Vehicle | Direct | -0.042 | | | | 0.021 | | | | -0.010 | 0.015 |
| C19 | Int-Tk 1T | Direct | 0.042 | | | | 0.000 | | | | 0.021 | 0.153 |
| C20 | Int-Tk 2T | Direct | 0.042 | | | | 0.000 | | | | 0.021 | 0.030 |

FIG. 14

| Noise type | Average | | Standard deviation | | Hypothesis test |
|---|---|---|---|---|---|
| | Reference | Candidate | Reference | Candidate | |
| Babble | -0.029 | -0.505 | 0.229 | 0.564 | 0.448>0.082 |
| Vehicle | -0.016 | -0.625 | 0.146 | 0.646 | 0.609>0.094 |
| Int-Tlk, 2T | -0.073 | -0.453 | 0.218 | 0.579 | 0.380>0.088 |
| Int-Tlk, 2T | -0.047 | -0.458 | 0.153 | 0.574 | 0.411>0.084 |

FIG. 15

| | $MOS_{male}$ | $MOS_{female}$ | $\lvert MOS_{male} - MOS_{female} \rvert$ |
|---|---|---|---|
| C1 | -0.177 | -0.776 | 0.599 |
| C6 | -0.062 | 0.005 | 0.067 |

VOICE CODING AND DECODING METHOD AND DEVICE THEREFOR

BACKGROUND OF THE INVENTION

1. Field of the Invention

The present invention relates to voice coding and decoding method and device. More particularly, it relates to a renewal code-excited linear prediction coding and decoding method and a device suitable for the method.

2. Description of the Related Art

FIG. 1 illustrates a typical code-excited linear prediction coding method.

Referring to FIG. 1, a predetermined term of 1 frame of N consecutive digitized samples of a voice to be analyzed is captured in step 101. Here, the 1 frame is generally 20 to 30 ms, which includes 160 to 240 samples when the voice is sampled at 8 kHz. In the preemphasis step 102, a high-pass filtering is performed to filter removes direct current (DC) components from voice data of one frame collected. In step 103, linear prediction coefficients (LPC) are calculated as($a_1$, $a_2$, , . . . , $a_p$). These coefficients are convolved with the sampled frame of speech; s(n), n=0,1, . . . , N. Also, included are the last p values of the preceding frame, which predict each sampled speech value such that the residual error can be ideally represented by codebook by a stochastic excitation function. To avoid larger residual errors due to truncation at the edges of the frame, s(n) the frame of points is multiplied by a Hamming window, w(n) n=0,1, . . . , N; to obtain the windowed speech frame $s_w(n)$ n=0,1, . . . , N.

$$s_w(n)=s_p(n)w(n) \tag{1}$$

where, the weighting function w(n) is obtained by:

$$w(n) = 0.54 - 0.46\cos\left(\frac{2\pi n}{N-1}\right), n = 0, \ldots, N-1.$$

The LPC coefficients are calculated such that they minimize the value of the equation 2.

$$\sum_{n=0}^{N-1} (s_w(n) - \hat{s}(n))^2 \tag{2}$$

$$s_w(k) = 0, \text{ if } k < 0$$

where, $$\hat{s}(n)=a_1 s_w(n-1)+a_2 s_w(n-2)+ \ldots +a_p s_w(n-p).$$

Before the obtained LPC coefficients, $a_1$, are quantized and transmitted, they are converted into line spectrum pairs, $w_1$, (hereinafter, referred to as LSP) coefficients, increasing the transmission efficiency and having an excellent subframe interpolation characteristic in an LPC/LSP converting step 104. The LSP coefficients are quantized in step 105. The quantized LSP coefficients are inverse-quantized to synchronize the coder with a decoder, in step 106.

A voice term is divided into S subframes to remove the periodicity of a voice from the analyzed voice parameters and model the voice parameters to a noise codebook, in step 107. Here, for convenience of explanation, the number of subframes S is restricted to 4. An i-th voice parameter s=0,1,2,3, i=1,2, . . . p) with respect to an s-th subframe can be obtained by the following equation 3.

$$0.75 \times w_i(n-1) + 0.25w_i(n),\ s = 0 \tag{3}$$

-continued $$w_i^s = 0.5 \times w_i(n-1) + 0.5w_i(n),\ s = 1$$
$$0.25 \times w_i(n-1) + 0.75w_i(n),\ s = 2$$
$$w_i(n),\ s = 3$$

where, $w_i(n-1)$ and $w_i(n)$ denote i-th LSP coefficients of a just previous frame and a current frame, respectively.

In step 108, the interpolated LSP coefficients are converted back into LPC coefficients. These subframe LPC coefficients are used to constitute a voice synthesis filter 1/A(z) and an error weighting filter A(z)/A(z/γ) to be used in after steps 109, 110 and before step 112.

The voice synthesis filter 1/A(z) and the error weighting filter A(z)/A(z/γ) are expressed as following equations 4 and 5.

$$\frac{1}{A(z)} = \frac{1}{1 - a_1^s z^{-1} - a_2^s z^{-2} - \ldots - a_p^s z^{-p}} \tag{4}$$

In step 109, influences of a synthesis filter of a just $$\frac{A(z)}{A(z/\gamma)} = \frac{1 - a_1^s z^{-1} - a_2^s z^{-2} - \ldots - a_p^s z^{-p}}{1 - a_1^s \gamma z^{-1} - a_2^s \gamma^2 z^{-2} - \ldots - a_p^s \gamma^p z^{-p}} \tag{5}$$

previous frame are removed. A zero-input response (hereinafter called ZIR) $S_{ZIR}(n)$ can be obtained as following equation 6. Here, $\bar{s}$ (n) represents a signal synthesized in a previous subframe. The result of the ZIR is subtracted from an original voice signal s(n), and the result of the subtraction is called $s_d(n)$.

$$s_{zir}(n) = a_1^s s_{zir}(n-1) + a_2^s s_{zir}(n-2) + \ldots + a_p^s s_{zir}(n-p), \tag{6}$$

$$n = 0, \ldots, Ns - 1$$

$$s_{sir}(-k) = s(Ns - k),\ k = 1, \ldots, p$$

Negative indexing of the equation 6, $s_{ZIR}(-n)$ address end values of the preceeding subframe. A codebook is searched and filtered by the error weight LPC filter 202 to find an excitation signal producing a synthetic signal closest to $s_{dw}(n)$, in adaptive codebook search 113 and a noise codebook search 114. The adaptive and noise codebook search processes will be described referring to FIGS. 2 and 3.

FIG. 2 shows the adaptive codebook search process, wherein the error weighting filter A(z)/A(z/γ) at step 201 corresponding to equation 5 is applied to the signal $s_d(n)$ and the voice synthesis filter. Assuming that a signal which is resulted from applying the error weighting filter to the $s_d(n)$ is $s_{dw}(n)$ and an excitation signal formed with a delay of L by using the adaptive codebook 203 is $P_L(n)$, a signal filtered through step 202 is $g_a \bullet p_L'(n)$, and L* and $g_a$ minimizing the difference at step 204 between two signals are calculated by following equations 7 to 9.

$$e(n) = s_{dw}(n) - g_a \cdot p_L'(n) \tag{7}$$

$$L^* = \max_{20 \leqq L \leqq 147} \frac{\left(\sum_{n=0}^{N_S-1} s_{dw}(n)p_L'(n)\right)^2}{\sum_{n=0}^{N_S-1} p_L'(n)p_L'(n)} \tag{8}$$

$$g_a = \frac{\sum_{n=0}^{N_S-1} s_{dw}(n)p_L'(n)}{\sum_{n=0}^{N_S-1} p_L'(n)p_L'(n)} \tag{9}$$

When an error signal from the thus-obtained L* and $g_a$ is set $s_{ew}(n)$, the value is expressed as following equation 10.

$$s_{ew}(n)=s_{dw}(n)-g_a \cdot p'_L(n) \tag{10}$$

FIG. 3 shows the noise codebook search process. Typically, the noise codebook consists of M predetermined codewords. If an i-th codeword $c_i(n)$ among the noise codewords is selected, the codeword is filtered in step 301 to become $g_r \cdot c_i'(n)$. An optimal codeword and a codebook 302 gain are obtained by following equations 11 to 13.

$$e(n)=s_{ew}(n)-g_r \cdot c'_i(n) \tag{11}$$

A finally-obtained excitation signal of a voice filter is $$i^* = \max_{0 \leq i \leq M-1} \frac{\left( \sum_{n=0}^{Ns-1} s_{ew}(n)c'_i(n) \right)^2}{\sum_{n=0}^{Ns-1} c'_i(n)c'_i(n)} \tag{12}$$

given by:

$$g_r = \frac{\sum_{n=0}^{Ns-1} s_{ew}(n)c'_i(n)}{\sum_{n=0}^{Ns-1} c'_i(n)c'_i(n)} \tag{13}$$

$$r(n) = g_a \cdot P_{L*}(n) + g_r \cdot c_{i*}(n) \tag{14}$$

The result of equation 14 is utilized to renew the adaptive codebook for analyzing a next subframe.

The general performance of a voice coder depends on the time (processing delay or codec delay; unit ms) until a synthesis sound is produced after an analyzed sound is coded and decoded, the calculation amount (unit; MIPS (million instructions per second)), and the transmission rate (unit; kbit/s). Also, the codec delay depends on a frame length corresponding to the length of an input sound to be analyzed at a time during coding process. When the frame length is long, the codec delay increases. Thus, a difference in the performance of the coder according to the codec delay, the frame length and the calculation amount is generated between the coders operating at the same transmission rate.

SUMMARY OF THE INVENTION

One object of the present invention is to provide methods of coding and decoding a voice by renewing and using a codebook without a fixed codebook.

Another object of the present invention is to provide devices for coding and decoding a voice by renewing and using a codebook without a fixed codebook.

To accomplish one of the objects above, there is provided a voice coding method comprising: (a) the voice spectrum analyzing step of extracting a voice spectrum by performing a short-term linear prediction on voice signal; (b) the weighting synthesis filtering step of widening an error range in a formant region during adaptive and renewal codebook search by passing the preprocessed voice through a formant weighting filter and widening an error range in a pitch on-set region by passing the same through a voice synthesis filter and a harmonic noise shaping filter; (c) the adaptive codebook searching step of searching an adaptive codebook using an open-loop pitch extracted on the basis of the residual minus of a speech; (d) the renewal codebook searching step of searching a renewal excited codebook produced from an adaptive codebook excited signal; and (e) the packetizing step of allocating a predetermined bit to various parameters produced through steps (c) and (d) to form a bit stream.

To accomplish another one of the objects above, there is provided a voice decoding method comprising: (a) the bit unpacketizing step of extracting parameters required for voice synthesis from the transmitted bit stream formed of predetermined allocated bits; (b) the LSP coefficient inverse-quantizing step of inverse quantizing LSP coefficients extracted through step (a) and converting the result into LPCs by performing an interpolation sub-subframe by sub-subframe; (c) the adaptive codebook inverse-quantizing step of producing an adaptive codebook excited signal using an adaptive codebook pitch for each subframe extracted through the bit unpacketizing step and a pitch deviation value; (d) the renewal codebook producing and inverse-quantizing step of producing a renewal excitation codebook excited signal using a renewal codebook index and a gain index which are extracted through the bit unpacketizing step; and (e) the voice synthesizing step of synthesizing a voice using the excited signals produced through steps (c) and (d).

BRIEF DESCRIPTION OF THE DRAWING(S)

The invention is described with reference to the drawings, in which:

FIG. 4 is a block diagram of a coding portion in a voice coder/decoder according to the present invention;

Figure 1:
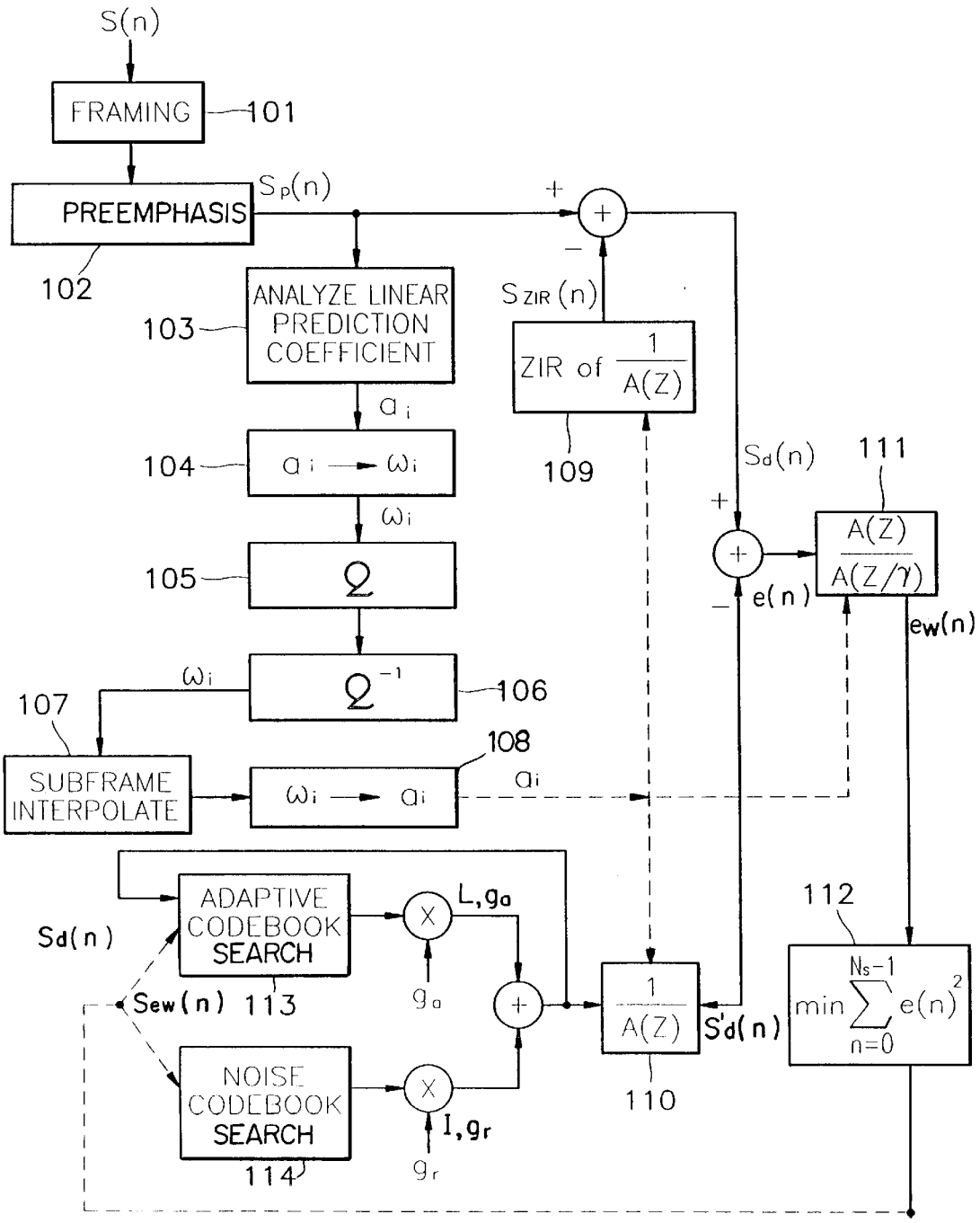
FIG. 1 (PRIOR ART)
FIG. 1 illustrates a typical CELP coder.
Figure 2:
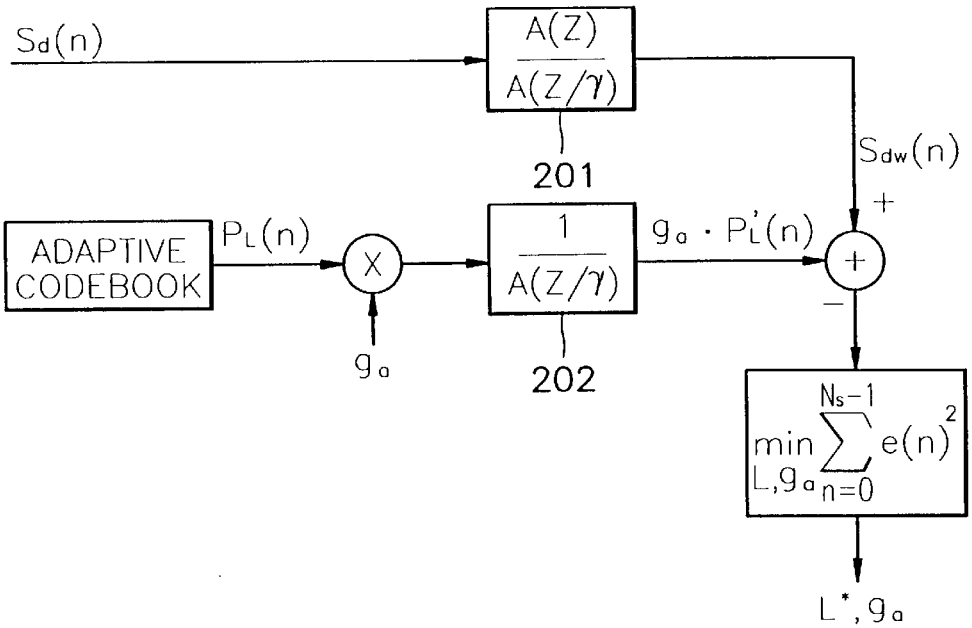
FIG. 2 (PRIOR ART)
FIG. 2 shows an adaptive codebook search process in the CELP coding method shown in FIG. 1.
Figure 3:
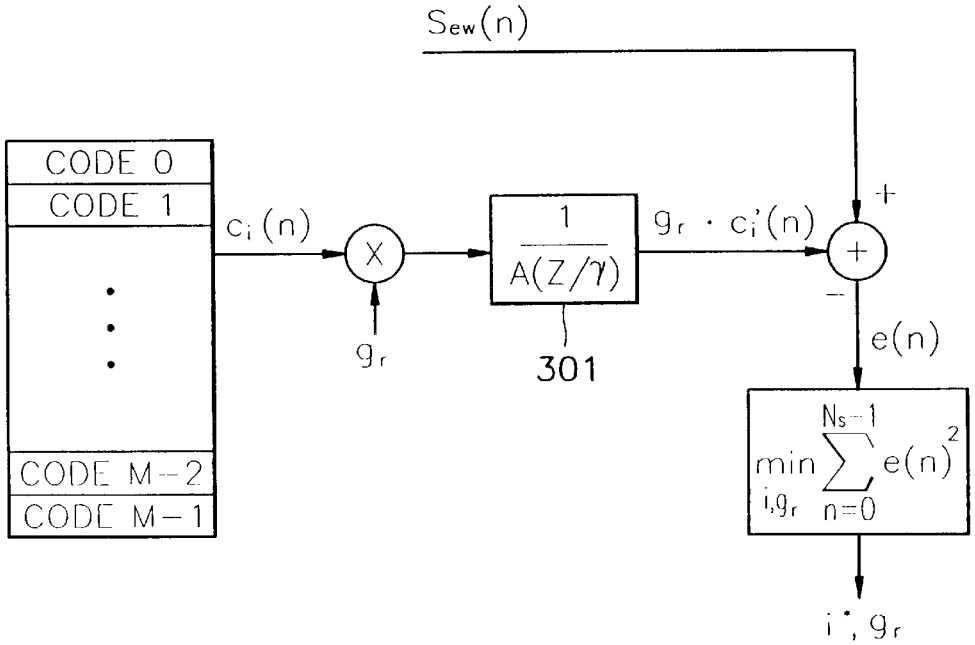
FIG. 3 (PRIOR ART)
FIG. 3 shows a noise codebook search process in the CELP coding method shown in FIG. 1.

FIGS. 8 and 9 are tables showing the test conditions for experiments 1 and 2, respectively; and FIGS. 10 to 15 are tables showing the test results of experiments 1 and 2.

DETAILED DESCRIPTION OF THE INVENTION

Referring to FIG. 4, a coding portion in an RCELP coder according to the present invention is largely divided into a preprocessing portion (401 and 402), a voice spectrum analyzing portion (430, 431, 432, 403 and 404), a weighting filter portion (405 and 406), an adaptive codebook searching portion (409, 410, 411 and 412), a renewal codebook searching portion (413, 414 and 415), and a bit packetizer 418. Reference numerals 407 and 408 are steps required for adaptive and renewal codebook search, and reference numeral 416 is a decision logic for the adaptive and renewal codebook search. Also, the voice spectrum analyzing portion is divided into an asymetric hamming window 430, a binomial window 431, noise prewhitening 432, and an LPC analyzer 403 for a weighting filter and a short-term predictor 404 for a synthesis filter. The short-term predictor 404 is divided in more detail into steps 420 to 426.

Operations and effects of the coding portion in the RCELP coder according to the present invention will now be described.

In the preprocessing portion, an input sound s(n) of 20 ms sampled at 8 kHz is captured and stored for a sound analysis in a framer 401. Thus, the number of voice samples is 160. A preprocessor 402 performs a high-pass filtering to remove current components from the input sound.

In the voice spectrum analyzing portion, a short-term LP is carried out on a voice signal high-pass filtered to extract a voice spectrum. First, the sound of 160 samples are divided into three terms. Each of them is called a subframe. In the present invention, 53, 53 and 54 samples are allocated to the respective subframes. Each subframe is divided into two sub-subframes, having 26 or 27 samples not overlapped or 53–54 samples overlapping per sub-subframe. On each of sub-subframe a 16-order LP analysis is performed in an LP analyzer 403. That is, the LP analysis is carried out a total of six times, and the results thereof become LPCs, where i is the frame number and j is the sub-subframe number. The last coefficient $\{a_i^j\}$ i=5 among six types of LPCs are representative of a current analysis frame. In the short-term predictor 404, a scaler 420 step-downs the 16-order LPC$\{a_i^j\}$ i=5 to the 10-order LPC$\{a_i^j\}$ scales and step-downs the LPCs, and an LPC/LSP converter 421 converts the LPCs into LSP coefficients having excellent transmission efficiency as described further herein. A vector quantizer (LSP VQ) 422 quantizes the LSP coefficients using an LSP vector quantization codebook 426 previously prepared through studying. A vector inverse-quantizer (LSP $VQ^{-1}$) 423 inversely quantizes the quantized LSP coefficients using the LSP vector quantization codebook 426 to be synchronized with the voice synthesis filter. This means matching the scaled and stepped down unquantized set of LSPs to one of a finite number of patterns of quantized LSP coefficients. A sub-subframe interpolator 424 interpolates the inverse-quantized LSP coefficients sub-subframe by sub-subframe. Since various filters used in the present invention are based on the LPCs, the interpolated LSP coefficients are converted back into the LPCs $a\{_i^j\}$ by an LSP/LPC converter 425. The 6 types of LPCs output from the short-term predictor 404 are employed to constitute a ZIR calculator 407 and a weighting synthesis filter 408. Now, each step used for voice spectrum analysis will be described in detail.

First, in the LPC analyzing step 403, an asymmetric Hamming window is multiplied to an input voice for LPC analysis as shown in following equation 15.

$$s_w(n)=s_p(n-147+B)w(n),\ n=0,\ldots,239 \tag{15}$$

The asymmetric window w(n) proposed in the present invention is expressed as following equation 16.

Figure 6:
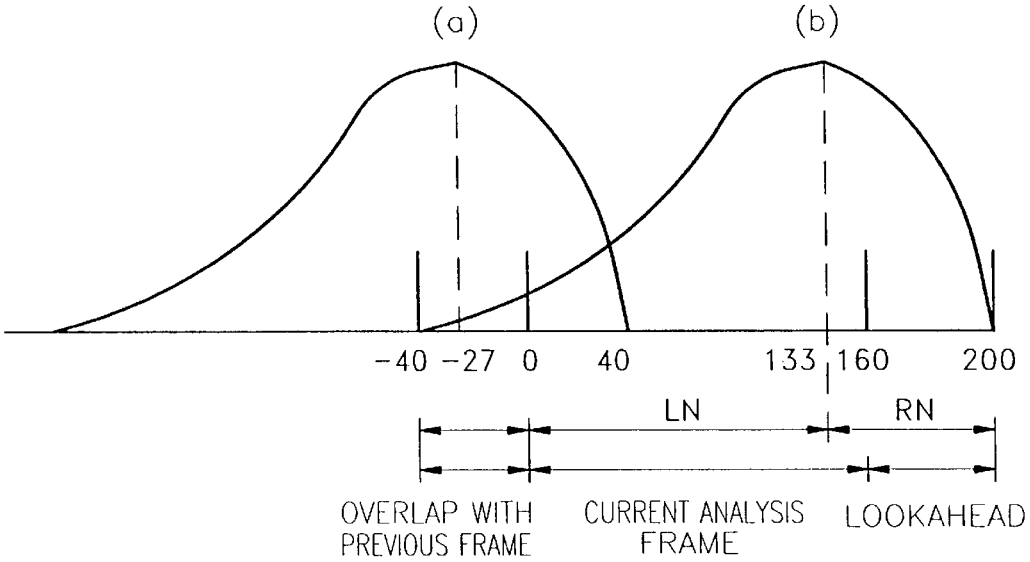
FIG. 6 is a graph showing an analysis section and the application range of an asymmetric Hamming window.

FIG. 6 shows the voice analysis and an applied example of w(n). In FIG. 6, (a) represents an asymmetric window of a just $$B=\begin{cases} 0 & \text{1st subframe \& 1st sub-subframe} \\ 26 & \text{1st subframe \& 2nd sub-subframe} \\ 53 & \text{2nd subframe \& 1st sub-subframe} \\ 79 & \text{2nd subframe \& 2nd sub-subframe} \\ 106 & \text{3rd subframe \& 1st sub-subframe} \\ 133 & \text{3rd subframe \& 2nd sub-subframe} \end{cases} \tag{16}$$

$$w(n)=\begin{cases} 0.54-0.46\cos\left(\dfrac{\pi n}{LN}\right) & n=0,\ldots,LN-1 \\ \cos\left(\dfrac{\pi(n-LN)}{2RN}\right) & n=LN,\ldots,LN+RN-1 \end{cases}$$

previous frame, and (b) represents the window of a current frame. In the present invention, the fact that LN equals 173 and RN equals 67 is employed. 80 samples are overlapped between a previous frame and a current frame, and the LPCs correspond to the coefficients of a polynomial when a current voice approximates to a p-order linear polynomial.

$$\sum_{n=0}^{239}(s_w(n)-\hat{s}(n))^2 \tag{17}$$

In the equation 17, $$\hat{s}(n)=a_1s_w(n-1)+a_2s_w(n-2)+\ldots+a_{16}s_w(n-16).$$

An autocorrelation method is utilized to obtain the LPCs. In the present invention, before the LPCs are obtained by the autocorrelation method, a spectral smoothing technique is introduced to remove a disorder generated during a sound synthesis. In the present invention, a binomial window such as following equation 18 is multiplied to an autocorrelation coefficient to widen the bandwidth of 90 Hz.

$$l(0)=1.0 \tag{18}$$

$$l(n+1)=l(n)\cdot\frac{m-n}{m+n+1},\ n=0,\ldots,15$$

$$\text{where } m=\left[\frac{-\log 2}{2\log\left(\cos\dfrac{90\pi}{2\cdot 8000}\right)}+0.5\right]$$

Also, a white noise correlation technique that 1.003 is multiplied to the first coefficient of the autocorrelation is introduced so that the signal-to-noise ratio (SNR) of 35 dB is suppressed.

Next, referring back to FIG. 4, in the LPC coefficient quantizing step, the scaler 420 converts a 16-order LPC into a 10-order LPC. Also, the LPC/LSP converter 421 converts the 10-order LPC into a 100 order LPC coefficient to quantize the LPC coefficients. The converted LSP coefficients are quantized to 23 bits in the LSP VQ 422, and then inversely quantized in the LSP $VQ^{-1}$ 423. A quantization algorithm uses a known linked-split vector quantizer. The inverse quantized LSP coefficient is sub-subframe interpolated in the sub-subframe interpolator 424, and then converted back into the 10-order LPC coefficient in the LSP/LPC converter 425.

A I(I=1, . . . ,10)-th voice parameter with respect to an s(s=0, . . . ,5)-th sub-subframe can be obtained by following equation 19.

$$w_i^s=\left(1-\frac{s+1}{6}\right)\cdot w_i(n-1)+\frac{s+1}{6}\,w_i(n),\ s=0,\ldots,5 \tag{19}$$

In equation 19, $w_i(n-1)$ and $w_i(n)$ represent i-th LSP coefficients of a just previous frame and a current frame, respectively.

Next, the weighting filter portion will be described.

The weighting filter includes a formant weighting filter 405; and a harmonic noise shaping filter 406.

The voice synthesis filter 1/A(z) and the formant weighting filter W(z) can be expressed as following equation 20.

$$\frac{1}{A(z)}=\frac{1}{1-\bar{a}_1^sz^{-1}-\bar{a}_2^sz^{-2}-\ldots-\bar{a}_p^sz^{-p}}$$

The formant weighting filter W(z) 405 passes the preprocessed voice and widens the error range in a formant region $$W(z)=\frac{A(z/\gamma_1)}{A(z/\gamma_2)}=\frac{1-a_1^s\gamma_1z^{-1}-a_2^s\gamma_1^2z^{-2}-\ldots-a_{16}^s\gamma_1^{16}z^{-16}}{1-a_1^s\gamma_2z^{-1}-a_2^s\gamma_2^2z^{-2}-\ldots-a_{16}^s\gamma_2^{16}z^{-16}} \tag{20}$$

during adaptive and renewal codebook search. The harmonic noise shaping filter 406 is used to widen the error range in a pitch on-set region, and the type thereof is the same as following equation 21.

$$P(z)=1-g_r z^{-T} \tag{21}$$

In the harmonic noise shaping filter 406, a delay T and a gain value $g_r$ can be obtained by following equation 22. When a signal formed after $s_p(n)$ has passed through the formant weighting filter W(z) 405 is set $s_{ww}(n)$, the following equations 22 are organized.

$$T = \max_{\substack{P_{OL}-5 \leqq L \leqq P_{OL}+5,\\ 2P_{OL}-5 \leqq L \leqq 2P_{OL}+5,\\ P_{OL}/2-5 \leqq L \leqq P_{OL}/2+5}} \frac{\sum_{n=0}^{Ns-1} (s_{ww}(n)s_{ww}(n-L))^2}{\sum_{n=0}^{Ns-1} s_{ww}(n-L)s_{ww}(n-L)} \tag{22}$$

$$g_r = \frac{\sum_{n=0}^{Ns-1} s_{ww}(n)s_{ww}(n-L)}{\sum_{n=0}^{Ns-1} s_{ww}(n-L)s_{ww}(n-L)}$$

$P_{OL}$ in equation 22 denotes the value of an open-loop pitch calculated in a pitch searcher 409. The extraction of the open-loop pitch value obtains a pitch representative of a frame. On the other hand, the harmonic noise shaping filter 406 obtains a pitch representative of a current subframe and the gain value thereof. At this time, the pitch range considers two times and half times of the open-loop pitch.

The ZIR calculator 407 removes influences of the synthesis filter of a just previous subframe. The ZIR corresponding to the output of the synthesis filter when an input is zero represents the influences by a signal synthesized in a just previous subframe. The result of the ZIR is used to correct a target signal to be used in the adaptive codebook or the renewal codebook. That is, a final target signal $s_{wz}(n)$ is obtained by subtracting z(n) corresponding to the ZIR from an original target signal $s_w(n)$.

Next, the adaptive codebook searching portion will be described.

The adaptive codebook searching portion is largely divided into a pitch searcher 409 and an adaptive codebook updater 417.

Here, in the pitch searcher 409, an open-loop pitch $P_{OL}$ is extracted based on the residual of a speech. First, the voice $s_p(n)$ is corresponding sub-subframe filtered using 6 kinds of LPCs obtained in the LPC analyzer 403. When a residual minus signal is set $e_p(n)$, the $P_{OL}$ can be expressed as following equation 23.

$$P_{OL} = \max_{20 \leqq L \leqq 122,} \frac{\sum_{n=0}^{159} (e_p(n)e_p(n-L))^2}{\sum_{n=0}^{159} e_p(n-L)e_p(n-L)} \tag{23}$$

Now, an adaptive codebook searching method will be described.

A periodic signal analysis in the present invention is performed using a multi(3)-tap adaptive codebook method. When an excitation signal formed having a delay of L is set $v_L(n)$, an excitation signal for an adaptive codebook uses three $v_{L-1}(n)$, $v_L(n)$ and $v_{L+1}(n)$.

Figure 7:
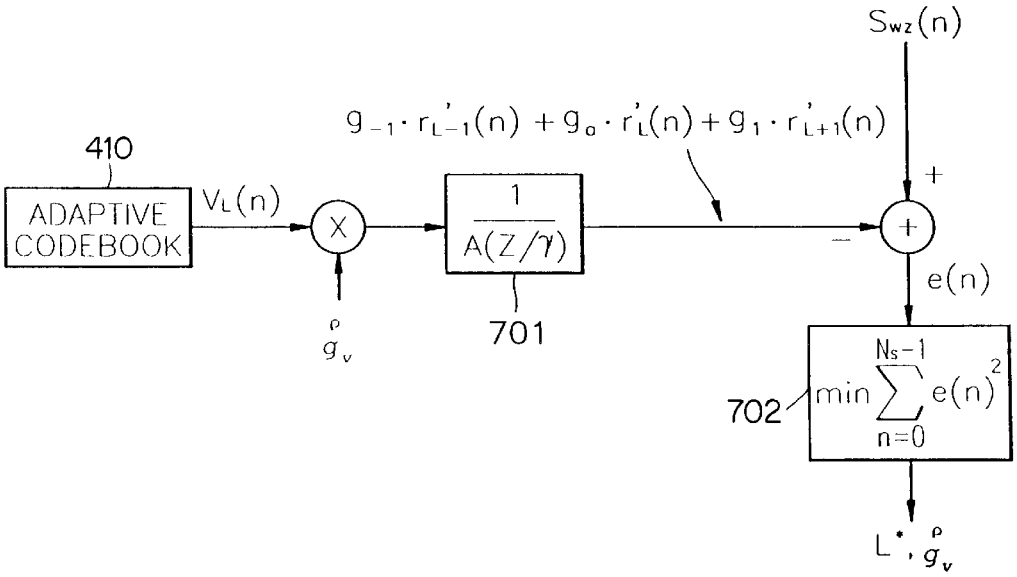
FIG. 7 shows an adaptive codebook search process in a voice coder according to the present invention.

FIG. 7 shows procedures of the adaptive codebook search. Signals from the adaptive codebook 410 (also shown in FIG. 4), having passed through a filter of step 701 are indicated by $g_{-1}r'_{L-1}(n)$, $g_0r'_L(n)$ and $g_1r'_{L+1}(n)$, respectively. The gain vector of the adaptive codebook becomes $g_v=(g_1, g_0, g_1)$ . Thus, the subtraction of the signals $g_{-1}r'_{L-1}(n)$, $g_0r'_L(n)$ and $g_1r'_{L+1}(n)$ from the target signal $s_{wz}(n)$ is expressed as following equation 24.

$$e(n)=s_{wz}(n)-g_{-1}\cdot r'_{L-1}(n)-g_0\cdot r'_L(n)-g_1\cdot r'_{L+1}(n)=s_{wz}(n)-R_L(n), \tag{24}$$

where $R_L(n)=g_{-1}\cdot r'_{L-1}(n)-g_0\cdot r'_L(n)-g_1\cdot r'_{L+1}(n)$

In step 702, e(n) (also shown in FIG. 4) is missing, obtaining L* and $g^{\rho}_{v}$.Reference is made back to FIG. 4. The $g_v=(g_{-1}, g_0, g_1)$ (see step 412) minimizing the sum of a square of equation 24 substitute each codeword one by one from the adaptive codebook gain vector quantizer 412 having 128 previously-comprised codewords so that the index of a gain vector satisfying the following equation 25 and a pitch $T_t$ of this case are obtained.

$$T_v, g_v^{\rho} = \min_{\substack{T_1 \leqq T \leqq T_2,\\ (g_{-1},g_0,g_1) \in \text{codebook of } g_v}} (e_v(n))^{\rho}{}^2 \tag{25}$$

Here, the pitch search range is different in each subframe as shown in equation 26.

$$T_1 = \begin{cases} P_{OL} \text{ of prevous frame} - 3, \text{ for 1st subframe} \\ P_{OL} \text{ of current frame} - 3, \text{ for 2nd subframe} \\ T_V \text{ of 2nd subframe} - 3, \text{ for 3rd subframe} \end{cases} \tag{26}$$

$$T_2 = T_1 + 2$$

An adaptive codebook 410 excitation signal $v_g(n)$ after the adaptive codebook search can be represented by following equation 27.

$$v_g(n) = \sum_{i=-1}^{1} g_i \cdot v_{T_v+i}(n) \tag{27}$$

Next, the renewal codebook searching portion will be described.

A renewal excitation codebook generator 413 produces a renewal excited codebook 414 from the adaptive codebook excitation signal $v_g(n)$ of equation 27. The renewal codebook 414 is modeled to the adaptive codebook 410 and utilized for modeling a residual signal. That is, a conventional fixed codebook models a voice in a constant pattern stored in a memory regardless of an analysis speech, whereas the renewal codebook renews an optimal codebook analysis frame by analysis frame.

Next, the memory updating portion will be described.

The sum r(n) of adaptive and renewal codebook excitation signals $v_g(n)$ and $c_g(n)$ calculated from the above result becomes the input of a weighting synthesis filter 408 comprised of the formant weighting filter W(z) and the voice synthesis filter 1/A(z) each having a different order of equation, and r(n) is used for an adaptive codebook updater 417 to update the adaptive codebook for analysis of a next subframe. Also, the summed signal is utilized to calculate the ZIR of a next subframe by operating the weighting synthesis filter 408.

Next, the bit packetizer 418 will be described.

The results of voice modeling are LSP coefficients, $\Delta T=(T_{v1}-P_{OL}, T_{v2}-P_{OL}, T_{v3}-P_{OL})$corresponding to the subtraction of the open-loop pitch $P_{OL}$ from the pitch $T_v$ of the adaptive codebook for each subframe, the index (which is represented as an address in FIG. 4) of a quantized gain vector, the codebook index (address of c(n)) of the renewal codebook for each subframe, and the index of a quantized gain $g_c$. A bit allocation as shown in Table 1 is performed on each parameter.

| Parameter | | Bit Allocation Sub 1 | Sub 2 | Sub 3 | Total/ frame |
|---|---|---|---|---|---|
| LSP | | | 23 | | 23 |
| Adaptive | Pitch | 2.5 | 7 | 2.5 | 12 |
| Codebook | Gain | 6 | 6 | 6 | 18 |
| Renewal | Index | 5 | 5 | 5 | 15 |
| Excitation | Gain | 4 | 4 | 4 | 12 |
| Codebook Total | | | | | 80 |

Figure 5:
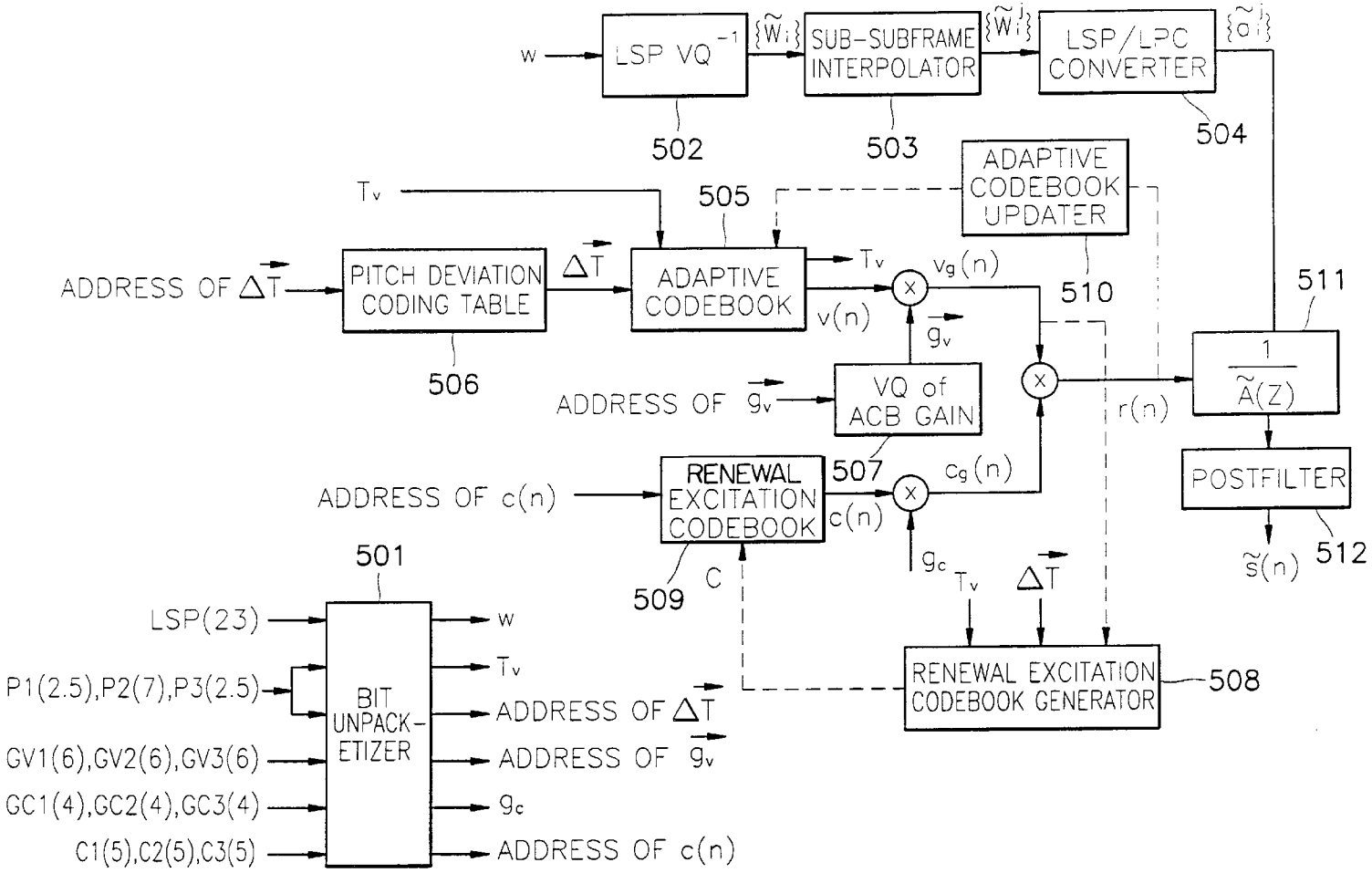
FIG. 5 is a block diagram of a decoding portion in a voice coder/decoder according to the present invention.

FIG. 5 is a block diagram showing a decoding portion of a RCELP decoder according to the present invention, which largely includes a bit unpacketizer 501, an LSP inversely quantizing portion (502, 503 and 504), an adaptive codebook inverse-quantizing portion (505, 506 and 507), a renewal codebook generating and inverse-quantizing portion (508 and 509) and a voice synthesizing and postprocessing portion (511 and 512). Each portion performs an inverse operation of the decoding portion.

The operations and effects of the decoding portion in the RCELP decoder according to the present invention will be described referring to the configuration of FIG. 5.

First, the bit unpacketizer 501 performs an inverse operation of the bit packetizer 418. Parameters required for a voice synthesis are extracted from 80 bits of bit stream which is allocated as shown in table 1 and transmitted. The necessary parameters are LSP coefficients, $\Delta T=(T_{v1}-P_{OL}, T_{v2}-P_{OL}, T_{v3}-P_{OL})$ corresponding to the subtraction of the open-loop pitch $P_{OL}$ from the pitch $T_v$ of the adaptive codebook for each subframe, the index (which is represented as an address in FIG. 4) of a quantized gain vector, the codebook index (address of c(n)) of the renewal codebook for each subframe, and the index of a quantized gain $g_c$.

Then, in the LSP inverse quantizing portion (502, 503 and 504), a vector inverse-quantizer LSP $VQ^{-1}$ 502 inversely quantizes LSP coefficients, and a sub-subframe interpolator 503 interpolates the inverse-quantized LSP coefficients $\{\tilde{W}_i^j\}$ frame by frame, and an LSP/LPC converter 504 converts the result $\{\tilde{W}_i^j\}$ back into LPC coefficients $\{\tilde{a}_i^j\}$.

Next, in the adaptive codebook inverse-quantizing portion (505, 506 and 507), an adaptive codebook excitation signal $v_g(n)$ is produced using an adaptive codebook pitch $T_v$ and a pitch deviation value for each subframe which are obtained in the bit unpacketizing step 501.

In the renewal codebook generating and inverse quantizing portion (508 and 509), a renewal excitation codebook excitation signal $c_g(n)$ is generated using a renewal codebook index (address of c(n)) and a gain index $g_c$ which are obtained under a packet in a renewal excitation codebook generator 508, so that a renewal codebook is produced and inversely quantized.

In the voice synthesizing and postprocessing portion, an excitation signal r(n) generated by the renewal codebook generating and inverse-quantizing portion becomes the input of a synthesis filter 511 having LPC coefficients converted by the LSP/LPC converter 504, and undergoes a postfilter 512 to improve the quality of a renewed signal $\tilde{s}(n)$ considering a human's hearing characteristic.

The results of inspection of the RCELP coder and decoder according to the present invention by an absolute category rating (ACR) experiment 1 as an effect experiment with respect to a transmission channel and a comparison category rating (CCR) experiment 2 as an effect experiment with respect to a peripheral background noise will now be shown. FIGS. 8 and 9 shows test conditions for experiments 1 and 2.

FIGS. 10 to 15 shows the test results of experiments 1 and 2. Specifically, FIG. 10 is a table showing the test results of experiment 1. FIG. 11 is a table showing the verification of the requirements for the error free, random bit error, tandemming and input levels. FIG. 12 is a table showing the verification of the requirements for missing random frames. FIG. 13 is a table showing the test results of experiment 2. FIG. 14 is a table showing the verification of the requirements for the babble, vehicle, and interference talker noise. And, FIG. 15 is a table showing the verification of the talker dependency.

The RCELP according to the present invention has a frame length of 20 ms and a codec delay 45 ms, and is realized at a transmission rate of 4 kbit/s.

The 4 kbit/s RCELP according to the present invention is applicable to a low-transmission public switched telephone network (PSTN) image telephone, a personal communication, a mobile telephone, a message retrieval system, tapeless answering devices.

As described above, the RCELP coding method and apparatus proposes a technique called as a renewal codebook so that a CELP-series coder can be realized at a low transmission rate. Also, a sub-subframe interpolation causes a change in tone quality according to a subframe to be minimized, and adjustment of the number of bits of each parameter makes it easy to expand to a coder having a variable transmission rate.

What is claimed is:

1. A voice coding method for coding a voice signal, comprising the steps of:

(a) extracting a voice spectrum from an input voice signal by performing a short-term linear prediction on the voice signal to obtain a preprocessed voice signal;

(b) widening an error range in a formant region during an adaptive and renewal codebook search by passing said preprocessed voice signal through a formant weighting filter, and widening an error range in a pitch on-set region by passing the preprocessed voice signal through a voice synthesis filter and a harmonic noise shaping filter;

(c) searching an adaptive codebook using an open-loop pitch extracted on the basis of a residual signal of the voice signal, and producing an adaptive codebook excited signal;

(d) searching a renewal excited codebook produced from the adaptive codebook excited signal and a previous renewal codebook excited signal and producing a renewal codebook excitation signal; and (e) packetizing predetermined bits of the voice signal and allocated parameters produced as output from steps (c) and (d) to form a bit stream.

2. A voice coding method as claimed in claim 1, further comprising a preprocessing step of collecting and high-pass filtering a voice signal received to be coded by a predetermined frame length for voice analysis.

3. A voice coding method as claimed in claim 1, wherein the formant weighting filter and the voice synthesis filter, each having an equation of a different order, are used in the weighting synthesis filtering step (b).

4. A voice coding method as claimed in claim 3, wherein the order of equation of said formant weighting filter is 16 and the order of equation of the voice synthesis filter is 10.

5. A voice decoding method for decoding a bit stream into a synthesized voice comprising the steps of:

(a) extracting parameters required for voice synthesis from a transmitted bit stream formed of predetermined allocated bits;

(b) inverse quantizing LSP coefficients extracted through step (a) and converting the result into LPCs by performing an interpolation sub-subframe by sub-subframe;

(c) producing an adaptive codebook excited signal using an adaptive codebook pitch for each subframe extracted through said bit unpacketizing step (a) and a pitch deviation value;

(d) producing a renewal excitation codebook excited signal using a renewal codebook index and a gain index which are extracted through said bit unpacketizing step (a); and (e) synthesizing a voice using said excited signals produced through steps (c) and (d).

6. A voice coding apparatus for coding a voice signal comprising:

a voice spectrum analyzing portion for extracting a voice spectrum by performing a short-term linear prediction on an input voice signal to obtain a preprocessed voice signal;

a weighting synthesis filter for widening an error range in a formant region during an adaptive and renewal codebook search by passing said preprocessed voice signal through a formant weighting filter, and widening an error range in a pitch on-set region by passing said preprocessed voice through a voice synthesis filter and a harmonic noise shaping filter;

an adaptive codebook searching portion for searching an adaptive codebook using an open-loop pitch extracted on the basis of a residual signal of the voice signal, and producing an adaptive codebook excited signal;

an adaptive codebook searching portion for searching a renewal excited codebook produced from the adaptive codebook excited signal and a previous renewal codebook excitation signal, and producing a renewal codebook excitation signal; and a packetizing portion for packetizing predetermined bits of the voice signal and parameters produced as output from said adaptive and renewal codebook searching portions to form a bit stream.

7. A voice coding apparatus as claimed in claim 6, further comprising a preprocessing portion for collecting and high-pass filtering a voice signal received to be coded by a predetermined frame length for voice analysis.

8. A voice coding apparatus as claimed in claim 6, wherein. said weighting synthesis filter includes a formant weighting filter and a voice synthesis filter each having an equation of a different order.

9. A voice coding apparatus as claimed in claim 6, wherein. the order of equation of said formant weighting filter is 16 and the order of equation of said voice synthesis filter is 10.

10. A voice decoding apparatus for decoding a bit stream into a synthesized voice, comprising:

a bit unpacketizing portion for extracting parameters required for voice synthesis from said transmitted bit stream formed of predetermined allocated bits;

an LSP coefficient inverse-quantizing portion for inverse quantizing LSP coefficients extracted by said bit unpacketizing portion and converting the LSP coefficients into LPCs by performing an interpolation sub-subframe by sub-subframe;

an adaptive codebook inverse-quantizing portion for producing an adaptive codebook excited signal using an adaptive codebook pitch for each subframe extracted by said bit unpacketizing portion and a pitch deviation value;

a renewal codebook producing and inverse-quantizing portion for producing a renewal excitation codebook excited signal using a renewal codebook index and a gain index which are extracted by said bit unpacketizing portion; and a voice synthesizing portion for synthesizing a voice using said excited signals produced by said adaptive codebook inverse-quantizing portion and said renewal codebook producing and inverse-quantizing portion.

* * * * *